United States Patent [19]

Lutz et al.

[11] Patent Number: 4,911,579

[45] Date of Patent: Mar. 27, 1990

[54] SWIVEL ARRANGEMENT FOR CONNECTING A BORING OR REAMING TOOL TO A CABLE

[75] Inventors: Mark E. Lutz; Douglas P. Kelley, both of King County, Wash.; Kenneth E. Fender, Camden County, N.J.

[73] Assignee: FlowMole Corporation, Kent, Wash.

[21] Appl. No.: 146,959

[22] Filed: Jan. 22, 1988

[51] Int. Cl.[4] ..... E02D 29/10

[52] U.S. Cl. ..... 405/184; 405/154; 175/62

[58] Field of Search ..... 405/154, 174, 184; 403/23, 286; 175/61, 62; 166/385

[56] References Cited

U.S. PATENT DOCUMENTS

| | | | |
|---|---|---|---|
| 176,201 | 4/1876 | Scott | 405/184 |
| 3,760,595 | 9/1973 | Stewart et al. | 405/184 |
| 4,507,019 | 3/1985 | Thompson | 405/154 |
| 4,648,746 | 3/1987 | Abinett | 405/184 |
| 4,671,703 | 6/1987 | Schmidt | 405/184 |
| 4,674,579 | 6/1987 | Geller et al. | 175/424 X |
| 4,754,526 | 7/1988 | Tremoulet et al. | 175/424 |

FOREIGN PATENT DOCUMENTS

| | | | |
|---|---|---|---|
| 671548 | 5/1952 | United Kingdom | 405/184 |

*Primary Examiner*—Randolph A. Reese
*Assistant Examiner*—John A. Ricci
*Attorney, Agent, or Firm*—Flehr, Hohbach, Test, ALbritton & Herbert

[57] ABSTRACT

A swivel arrangement especially suitable for connecting the back end of a reaming tool to the front end of utility cable during installation of the latter underground is disclosed herein. This arrangement includes a swivel mechanism which is smaller in cross-section than the reaming tool and utility cable apparatus, for connecting the swivel mechanism to and between the reaming tool and utility cable, whereby to create an axially extending radial gap between the tool and cable. In accordance with one feature of the disclosed swivel arrangement, one end of the swivel mechanism is fixedly connected to the back end of the reaming tool to prevent relative lateral moement between the tool. In accordance with another feature, the arrangement includes apparatus no larger in cross-section that the remaining tool and substantially equal to or larger than the utility cable extending around at least a substantial axial segment of the swivel mechanism for reducing the axial extent of the radial gap between the tool and utility cable.

13 Claims, 3 Drawing Sheets

SWIVEL ARRANGEMENT FOR CONNECTING A BORING OR REAMING TOOL TO A CABLE

The present invention relates generally to means for connecting a boring tool to cable during installation of the latter underground and more particularly to a specifically designed swivel arrangement especially suitable for connecting back reaming tool with utility cable during installation of the latter within a pre-bored underground pilot hole.

A method sometimes used by FlowMole, Inc., Assignee of this application, to install underground utilities consists of boring a pilot hole and pulling the utility cable back through the hole. A back reamer is used to size or gauge (enlarge or otherwise smooth out) the hole ahead of the utility and a swivel mechanism provided for connecting the back reamer with the utility cable in order to prevent the later from twisting as the back reamer rolls about its own axis, as it tends to do during movement through the pilot hole.

Utilities fall into two generalized categories, those that may be internally gripped, for example, hollow pipes (which also contemplate tubes), and those that may be externally gripped, for example, electrical cables or hollow tubes, pipes or the like. For purposes of convenience, both will be referred to as utility cable.

FIG. 1 illustrates a swivel arrangement heretofore used by FlowMole for connecting the back end of a back reaming tool to the front end of hollow utility cable. The reaming tool which may be conventional and/or readily providable is generally indicated by the reference number 10. The hollow utility cable (e.g. pipe, tube or the like) is shown at 12 and the swivel arrangement is generally indicated by the reference number 14.

Swivel arrangement 14 includes an axially extending, readily providable swivel mechanism 16 which is joined at its front end to the back end of reaming tool 10 by means of a clevis 18 and connecting pin 20, whereby the reaming tool is allowed to pivot relative to the swivel mechanism. The back end of the swivel mechanism is connected internally to the front end section 21 of cable 12 by means of a commercially available plug 22, specifically a Steve Vik pulling eye, and a link 23 connected to an eye bolt 24 forming part of the plug. Thus, the reaming tool is allowed to rotate about its own axis relative to the cable.

FIG. 2 illustrates a swivel arrangement 30 for connecting reaming tool 10 externally around a front end section of a utility cable 32 in a heretofore provided way. Arrangement 30 includes the same swivel mechanism 16 forming part of arrangement 14 and has its front end connected to reaming tool 0 in the same manner, that is, utilizing clevis 18 and cooperating pin 20. The back end of the swivel mechanism is connected to utility cable 32 by means of a contracting wire mesh grip 34 which, like plug 22 is commercially readily available.

There are a number of disadvantages to the attachment techniques associated with swivel arrangements 14 and 30 discussed above. First, it should be noted that because the swivel mechanism is smaller in cross-section than the reaming tool, and, in some cases, the utility cable (as in FIG. 1), an axially extending radial gap is created between the tool and the utility cable around the swivel mechanism.

The radial gap between the reaming tool and utility cable can be a source of drag or stoppage due to a protruding obstruction or collapse in the tunnel. Moreover, different types of soils can accumulate behind the reaming tool within this gap, thereby preventing the tool from moving forward. In many cases, gravel or aggregate can build up in the gap, creating a wedge action that prevents the reaming tool from being advanced of retracted in the tunnel.

Another problem associated with both of the arrangements illustrated in FIGS. 1 and 2 relates to the way in which the swivel mechanism is connected to the reaming tool and cable, especially the reaming tool. More specifically, as illustrated in FIGS. 1 and 2, in each case, the swivel mechanism is pivotally connected to clevis 18 forming part of the reaming tool and it is generally loosely connected to its associated utility cable. This allows the swivel mechanism to move laterally relative to the reaming tool and thereby angularly misalign itself with respect to the boring tool. This may result in binding of the tool which can cause a rough cut tunnel or possibly failure of the connection between the boring tool and swivel mechanism. Depending on the weight and diameter of the utility cable, upward flotation may also occur and this can cause the cable to drag and/or the tunnel to collapse. Moreover, because of this freedom of movement between the swivel mechanism and the reaming tool and utility cable, it is difficult to reverse the direction of the tool.

In view of the foregoing, it is a primary object of the present invention to provide a swivel arrangement which overcomes the various disadvantages described above.

A more particular object of the present invention is to provide a swivel arrangement which substantially eliminates the axially extending radial gap between its reaming tool and cooperating utility cable.

Another particular object of the present invention is to minimize and preferably entirely eliminate any lateral movement between the swivel mechanism forming part of the overall swivel arrangement disclosed herein and the reaming tool in order to reduce and preferably entirely eliminate misalignment between the two.

As will be disclosed in more detail hereinafter, a swivel arrangement for joining a reaming tool or boring device generally with a utility cable or any type of cable generally is disclosed herein. For purposes of convenience, the swivel arrangement will be disclosed in association with a reaming tool for installing underground utility cable within a pre-bored underground pilot hole. However, it is to be understood that the swivel arrangement can be used with boring tools and cables generally.

The swivel arrangement disclosed herein includes a swivel mechanism which has a front end and a back end and which, in most cases, is smaller in cross-section than the reaming tool and the utility cable, whereby when the swivel mechanism is connected between the two an axially extending radial gap is created therebetween. The swivel mechanism is connected at its front end to the back end of the reaming tool and its back end is connected to the front end of the utility cable.

In accordance with one feature of the present invention, the overall swivel arrangement includes means no larger in cross section than the reaming tool and substantially equal to or larger than the utility cable extending around at least a substantial axial segment of the swivel mechanism for reducing the axial extent of the previously recited radial gap between the reaming tool and utility cable, thereby reducing and preferably entirely eliminating the various problems associated with the gap, as described above. In accordance with a second feature of the present invention, the front end of the swivel mechanism is rigidly connected to the back end of the reaming tool, whereby to eliminate any misalignment therebetween. In one embodiment of the present invention, the back end of the swivel arrangement is also rigidly connected to the front end of the utility cable for the same reason.

The present invention will be described in more detail hereinafter in conjunction with the drawings wherein.

Figure 1:
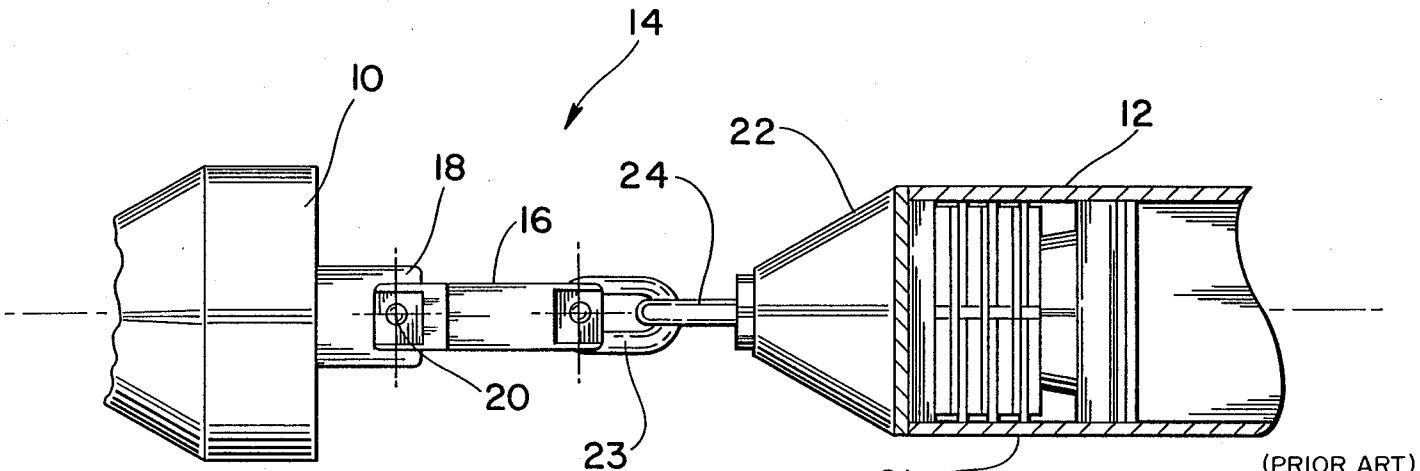
(PRIOR ART) FIG. 1.
FIG. 1 and FIG. 2 are side elevational views of conventional swivel arrangements for connecting a back reamer or other type of boring device to the front end of an internally connected cable and an externally connected cable, respectively, as heretofore carried out by Assignee of the present invention.
Figure 2:
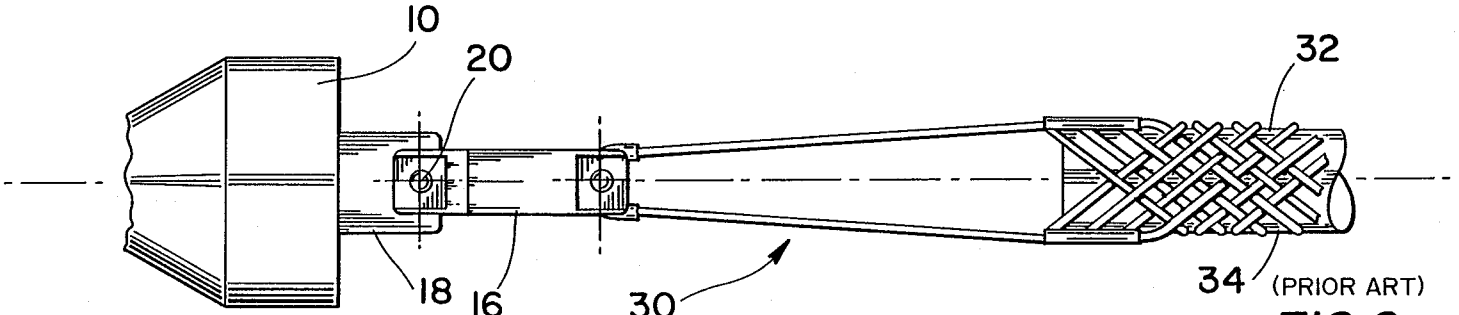
(PRIOR ART) FIG. 2.

Inasmuch as FIGS. 1 and 2 have been discussed previously, attention is immediately directed to FIG. 3 which, as stated above, is directed to a swivel arrangement designed in accordance with one embodiment of the present invention. The swivel arrangement, generally indicated by the reference numeral 34, is shown connected at its front end with the back end of a conventional back reamer 36 which may correspond in function to the previously recited back reamer 10. The back end of swivel arrangement 34 is shown connected internally to the forwardmost end section 38 of a hollow utility cable 40, specifically a hollow pipe or tube. As will be seen below, swivel arrangement 34 allows the back reamer 36 to swivel relative to utility cable 40 within the swivel plane 42 disposed between the two. In this way, the cable itself will not become twisted. At the same time, it should be noted that the swivel arrangement connects the cable with the back reamer in a way which substantially reduces the gap between the two, as compared with previously described swivel arrangement 14. In fact, the gap between back reamer 36 and cable 40, which gap is generally indicated by the reference numeral 44, is just large enough to position a wrench between the two for connecting and disconnecting the swivel arrangement to and from the back reamer, as will be seen. As will also be seen, swivel arrangement 34 connects the hollow utility cable 40 to back reamer 36 in a way which prevents the front end section 38 of the cable from moving laterally with respect to the back reamer.

Figure 3:
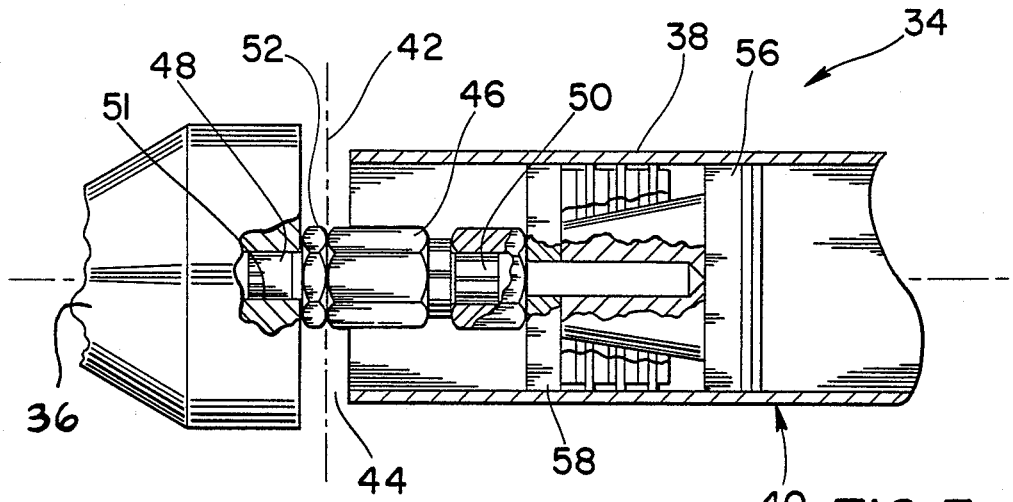
FIG. 3 is an enlarged, partially broken away side elevational view of a swivel arrangement which is designed in accordance with one embodiment of the present invention for connecting the back en of a back reamer or boring device generally with the front end of the cable, specifically a hollow pipe, in an internal manner.

Still referring to FIG. 3, swivel arrangement 34 is shown including a conventional or readily providable swivel mechanism 46 having a front concentrically positioned, externally threaded stud 48 and a similar back stud 50. The front stud is shown thread mounted into a cooperating internally threaded hole 51 concentrically disposed within the back side of back reamer 36. Stud 48 may be screwed into place in hole 51 or removed therefrom by means of a wrench surface 52 disposed around and fixedly connected to a back end section of the stud. Note that the wrench surface 52 is located within gap 44 and is readily accessibly by means of a wrench. It is to be understood that other suitable means, for example, a fixed pin in combination with an unthreaded stud and hole, could be used, or other suitable means. The access gap 44 also permits the expanding of plug 56 to engage the inner surface of cable or conduit 40 by first engaging wrench surface 47 through gap 44 and rotating the rear portion of swivel mechanism 46. In this regard, it should be noted that wrench surface 52 forms the outer surface of one side of the swivel mechanism while wrench surface 47 forms the outer surface of its other side.

The back end of swivel mechanism 46 is connected to the front end section 38 of cable 40, internally, by means of a plug 56 which may be identical in function to previously described Steve Vick plug 12. Structurally, the two plugs are only slightly different. One difference which can be seen in FIGS. 1 and 3 is that plug 56 has a flat front end 58 rather than the bullet shaped front end of plug 22. The plug is connected to stud 50 of swivel mechanism 46 by any suitable means, for example, by means of threads shown in FIG. 3 or a rigid pinned joint or other means. This connection can be made before the plug is inserted entirely in the cable.

Figure 4:
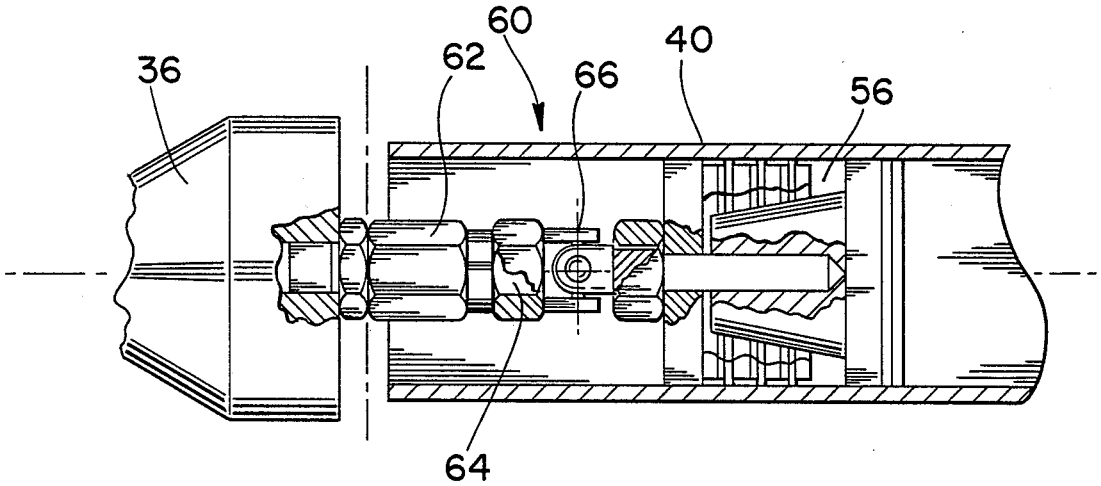
FIG. 4 is a view similar to FIG. 3 but illustrating a second embodiment of the swivel arrangement.

Turning to FIG. 4, attention is directed to a modified swivel arrangement 60 for connecting back reamer 36 with cable 40 in the same manner as arrangement 34. The only difference is that the swivel arrangement 64 forming part of arrangement 60 has its rearward stud 64 connected with plug 56 in a more flexible, less rigid manner, as indicated at 66. This allows a small amount of angular misalignment between the back reamer and cable 40 but not so much as to cause the overall assembly to bind. Means 66 could be, for example, a ball or universal joint, or other flexible joint.

Figure 5:
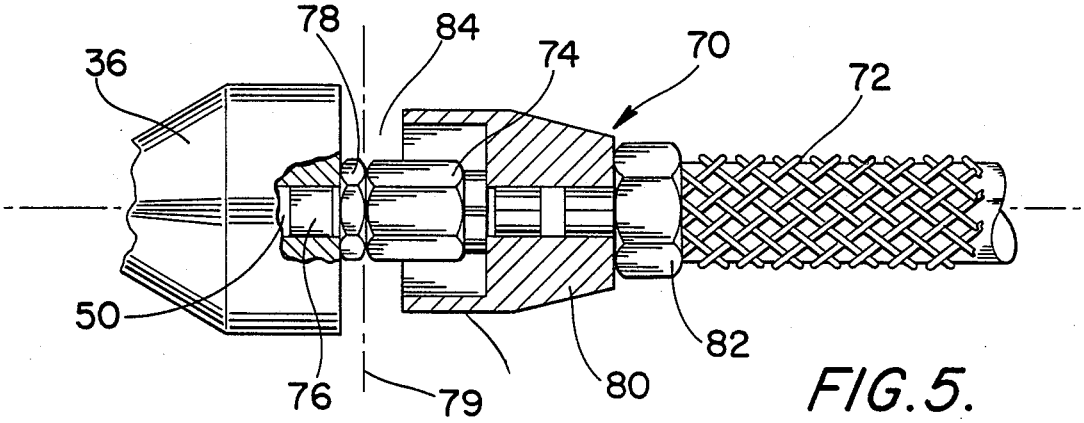
FIG. 5 is a partially broken away side elevational view of a swivel arrangement which is designed in accordance with the present invention for connecting the back end of a back reamer or boring device generally with the front end of a cable, in an external manner.

Turning now to FIG. 5, attention is directed to a swivel arrangement 70 for connecting the back end of back reamer 36 to the front end of a cable 72, externally rather than internally as in the case of arrangements 34 and 60. As illustrated in FIG. 5, the swivel arrangement 70 includes swivel mechanism 74 which may be identical in function to mechanism 46 or mechanism 62 and which may be connected to the back end of back reamer 36 in the same manner. For example, mechanism 74 may also include a forward externally threaded, co-axial stud 76 thread connected within the same internally threaded hole 51 recited above. Moreover, a similar wrench surface 78 is provided between the threaded end of the stud and the rest of the swivel mechanism just in front of the swivel plane 79 of the swivel mechanism.

The back end of swivel mechanism 74 is connected externally to cable 72 by means of an adaptor 80 and cooperating nut 82. Note specifically that the forward end section 83 of the adaptor extends over most of the swivel mechanism so as to define the gap 84 corresponding to gap 44 between back reamer 36 and the cable. Moreover, like arrangement 34, arrangement 70 rigidly connects the back reamer 36 to cable 72 in a co-axial manner, thus providing 111 of the advantages discussed previously.

Figure 6:
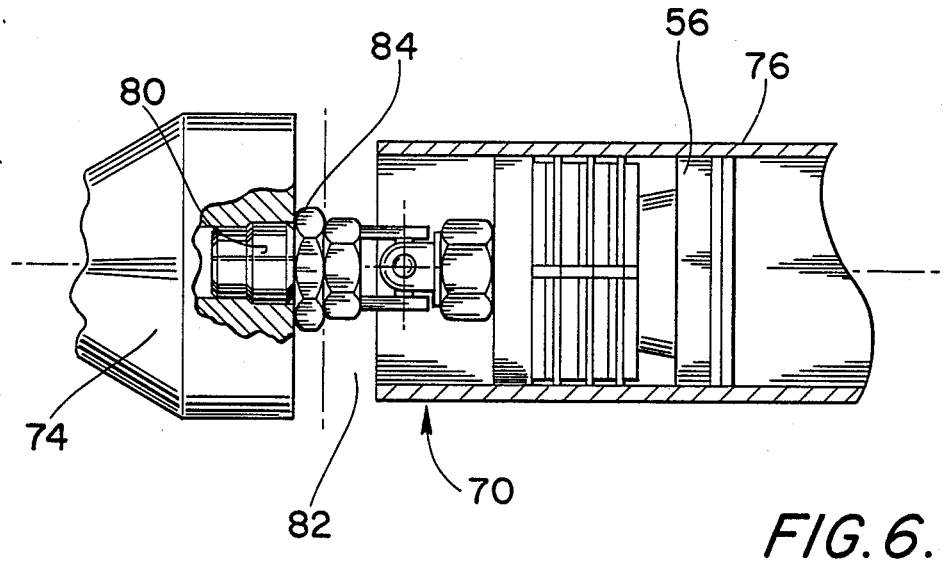
FIG. 6 is a view similar to FIGS. 3 and 4 but illustrating a further embodiment of the swivel arrangement shown there.
Figure 7:
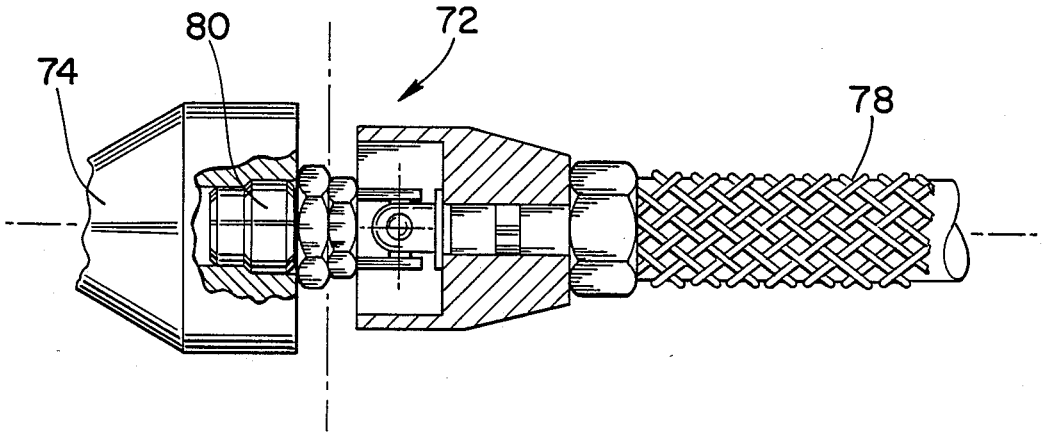
FIG. 7 is a view similar to FIG. 5 but illustrating the second embodiment shown there.

Turning to FIGS. 6 and 7, swivel arrangements 70 and 72 are shown connecting the back end of a reamer 74 to the front end of utility cables 76 and 78, respectively. The reamer 74 can be identical to the previously recited reamers and cables 76 and 78 can be identical to previously recited utility cables 40 and 72, respectively. Moreover, with one exception to be noted below, the swivel arrangements 70 and 72 can be identical to swivel arrangements 60 and 70, illustrated in FIGS. 4 and 5, respectively. The primary difference in arrangements 70 and 72 reside in their specific swivel mechanisms. Each of the arrangements 70 and 72 include readily providable swivel mechanisms 80 that are shorter longitudinally than the previously described swivel mechanisms and they extend partially into cooperating openings in the back end of the reaming tool, thus providing a more compact overall arrangement and resulting in a gap 82 between the reaming tool and utility cable. The wrench surface 84 serves to thread and unthread the front end of the swivel mechanism into and out of its cooperating opening in reaming tool 74, in the same manner as previously recited wrench surface 52. The wrench surface 86 forms the outer surface of the back side of the swivel mechanism 80 and functions in the same way as previously described wrench surface 47. Thus surface 86, when rotated, will enlarge its connected plug 56 to engage cable 76.

In all of the cases described above, the swivel arrangements were shown connecting a back reamer to a utility cable. It is to be understood that the present invention is equally applicable to connecting boring devices generally with all types of cables, pipes/tubes and conduits generally, not necessarily specific types of utility cables. In all of these cases, it is important that a gap between the back reamer or boring device and the cable, pipe, tube, conduit, or the like be minimized and that lateral movement between them to be minimized, as described above.

In addition, it should be noted that, in all cases, the swivel arrangements are no larger in cross section than the back reaming tool or boring device generally and substantially equal to or larger than the associated utility cable. In the embodiments illustrated in FIGS. 3, 4 and 6, the overall arrangement is substantially equal to the utility cable, when taking into account that the connecting plug is part of the swivel arrangement and is approximately equal in cross section to the conduit. Actually, the plug is smaller by the thinness of the conduit all but it may be considered substantially equal. In the embodiments illustrated in FIGS. 5 and 7, the overall swivel arrangement in each of these cases is larger in cross section than the utility cable since the connecting adaptor shown there forms part of each swivel arrangement and is larger in cross section than its associated cable. Also, in all of these cases, it is to be understood that the swivel mechanism per se does not form the present invention other than in combination with the rest of the swivel arrangement. Any swivel mechanism compatible with the objectives described above will suffice.

What is claimed:

1. An assembly for installing underground utility cable within a pre-bored underground pilot hole, comprising:

(a) an arrangement including a reaming tool and means for moving the reaming tool through said pilot hole, said reaming tool having drive means located within the means for moving the reaming tool through said pilot hole, for enlarging or otherwise smoothing out said pilot hole so as to accommodate said utility cable; and (b) first means for connecting the front end of said utility cable to the back end of said reaming tool as the latter is moved through and enlarges or otherwise smoothes out said pilot hole, whereby to position the cable within the hole, said connecting means including (i) a swivel mechanism having front and back ends and being smaller in cross-section than said reaming tool and said utility cable, (ii) second means for connecting the front and back ends of said swivel mechanism to the back end of said reaming tool and the front end of said utility cable, respectively, whereby to allow the reaming tool and cable to swivel relative to each other and whereby to create an axially extending radial gap between the tool and cable, (iii) means no larger in cross-section than said reaming tool and substantially equal to or greater in cross section than said utility cable extending around at least a substantially axial segment of said swivel mechanism for reducing the axial extent of the radial gap between the reaming tool and the utility cable, and (iv) means for joining the back end of said swivel mechanism around a front end segment of said cable and wherein said means are reducing the axial extent of said radial gap includes an adapter around said joining means.

2. An assembly according to claim 1 wherein said connecting means includes means for rigidly connecting the front end of said swivel mechanism to the back end of said reaming tool.

3. An assembly according to claim 1 wherein said connecting means including means for rigidly connecting the back end of said swivel mechanism to the front end of said cable.

4. An assembly according to claim 3 wherein said connecting means includes means for rigidly connecting the front end of said swivel mechanism to the back end of said reaming tool.

5. An assembly for installing underground utility cable within a pre-bored underground pilot hole, comprising:

(a) an arrangement including a reaming tool and means for moving said reaming tool through said pilot hole, said moving means including means for driving said reaming tool, for enlarging or otherwise smoothing out said pilot hole so as to accommodate said utility cable; and (b) means for connecting the front end of said utility cable to the back end of said reaming tool as the latter is moving through and enlarges or smoothes out said pilot hole, whereby to position the cable within the enlarged or otherwise smoothed out hole, said connecting means including (i) a swivel mechanism having front and back ends, (ii) pivot means for providing an additional degree of freedom, and (iii) means for connecting the front and back ends of said swivel mechanism to the back end of said reaming tool and the front end of said utility cable, respectively, whereby to allow the reaming tool and cable to swivel relative to each other, said connecting means including means for rigidly connecting the front end of said swivel mechanism to the back end of said reaming tool at a point substantially coaxial with the axis of said tool, whereby to prevent the front end of said swivel mechanism to move laterally with respect to the axis of said reaming tool.

6. An assembly according to claim 5 wherein said first-mentioned connecting means includes means for rigidly connecting the back end of said swivel mechanism to the front end of said utility cable at a point coaxial with the axis of said cable, whereby to prevent the back end of said swivel mechanism from moving laterally relative to the axis of said cable.

7. An assembly according to claim 6 wherein said swivel mechanism is smaller in cross-section than said reaming tool and said utility cable whereby to create an axially extending radial gap between the tool and cable, said assembly including means no larger in cross-section than said reaming tool and substantially equal to or greater in cross section than said utility cable extending around at least a substantial axial segment of said swivel mechanism for reducing the axial extent of said radial gap.

8. An assembly according to claim 7 wherein said utility cable is hollow, wherein said connecting means includes means for connecting the back end of said swivel mechanism to the front end of said cable within the latter, and wherein a front end section of said cable serves as said means for reducing the axial extent of said radial gap.

9. An assembly for installing underground utility cable within a pre-bored underground pilot hole, comprising:

(a) an arrangement including a reaming tool and means for moving said reaming tool through said pilot, said moving means including means for driving said reaming tool, for enlarging or otherwise smoothing gout said pilot hole so as to accommodate said utility cable; and (b) means for connecting the front end of said utility cable to the back end of said reaming tool as the latter is moving through and enlarges or smoothes out said pilot hole, whereby to position the cable within the enlarged or otherwise smoothed out hole, said connecting means including (i) a swivel mechanism having front and back ends, (ii) pivot means for providing an additional degree of freedom, and (iii) means for connecting the front and back ends of said swivel mechanism to the back end of said reaming tool and the front end of said utility cable, respectively, whereby to allow the reaming tool and cable to swivel relative to each other, said connecting means including means for rigidly connecting the front end of said swivel mechanism to the back end of said reaming tool at a point substantially coaxial with the axis of said tool, whereby to prevent the front end of said swivel mechanism to move laterally with respect to the axis of said reaming tool; said connecting means including means for joining the back end of said swivel mechanism around a front end segment of said cable and wherein said means for reducing the axial extent of said radial gap includes an adapter around said joining means.

10. An arrangement for connecting the back end of a boring tool to the front end of a utility cable to be located underground as the boring tool is moved through the ground, whereby to position the cable therein, said connecting arrangement comprising:

(a) a swivel mechanism which has front and back ends and which is smaller in cross-section than said boring tool and said cable;

(b) means for connecting the front and back ends of said swivel mechanism to the back end of said boring tool and the front end of said cable, respectively, whereby to allow the boring tool and cable to swivel relative to each other and whereby to create an axially extending radial gap between the tool and cable, said connecting means including means for rigidly connecting the front end of said swivel mechanism to the back end of said tool so that the front end of said swivel mechanism will not move laterally relative to said tool;

(c) means no larger in cross-section than said boring tool and substantially equal to or larger than said cable extending around at least a substantial axial segment of said swivel mechanism for substantially eliminating the axial extent of the radial gap; and (d) pivot means for providing an additional degree of freedom to the swivel mechanism.

11. An arrangement according to claim 10 wherein said cable is hollow, wherein said connecting means includes means for connecting the back end of said swivel mechanism to the front end of said cable within the latter, and wherein a front end section of said cable serves as said means for reducing the axial extent of said radial gap.

12. An arrangement according to claim 10 wherein said swivel mechanism extends partially into a cooperating opening in the back end of said boring tool.

13. An arrangement for connecting the back end of a boring tool to the front end of a utility cable to be located underground as the boring tool is moved through the ground, whereby to position the cable therein, said connecting arrangement comprising:

(a) a swivel mechanism which has front and back ends and which is smaller in cross-section than said boring tool and said cable;

(b) means for connecting the front and back ends of said swivel mechanism to the back end of said boring tool and the front end of said cable, respectively, whereby to allow the boring tool and cable to swivel relative to each other and whereby to create an axially extending radial gap between the tool and cable, said connecting means including means for rigidly connecting the front end of said swivel mechanism to the back end of said tool so that the front end of said swivel mechanism will not move laterally relative to said tool;

(c) means no larger in cross-section than said boring tool and substantially equal to or larger than said cable extending around at least a substantial axial segment of said swivel mechanism for substantially eliminating the axial extent of the radial gap; and (d) pivot means for providing an additional degree of freedom to the swivel mechanism; said connecting means including means for joining the back end of said swivel mechanism around a front end segment of said cable and wherein said means for reducing the axial extent of said radial gap includes an adapter around said joining means.

* * * * *